United States Patent [19]

Mooney et al.

[11] 4,089,482

[45] May 16, 1978

[54] AUTOMATIC WEB SPLICE CONTROL SYSTEM

[75] Inventors: John F. Mooney, West Chester; Allen Brent Woolston, Wynnewood, both of Pa.

[73] Assignee: Molins Machine Company, Inc., Cherry Hill, N.J.

[21] Appl. No.: 791,095

[22] Filed: Apr. 26, 1977

[51] Int. Cl.[2] ..... B65H 19/18

[52] U.S. Cl. ..... 242/58.1; 242/57; 242/58.3

[58] Field of Search ..... 242/58.1, 58.2, 58.3, 242/58.4, 58.5, 57; 235/92 DN; 156/504, 502

[56] References Cited

U.S. PATENT DOCUMENTS

| | | | |
|---|---|---|---|
| 3,232,548 | 2/1966 | Bent | 242/58.1 |
| 3,409,242 | 11/1968 | Kishioka | 242/58.1 |
| 3,841,944 | 10/1974 | Harris | 242/58.1 X |
| 3,994,449 | 11/1976 | Wales | 242/58.1 X |

*Primary Examiner*—Edward J. McCarthy
*Attorney, Agent, or Firm*—Seidel, Gonda & Goldhammer

[57] ABSTRACT

An automatic web splice control system for a web splicer apparatus including a running web roll and a ready web roll and a splice mechanism for splicing the expiring end of the running web to the leading end of the ready web. The system provides successive measurements of the length of web unwound from the running web roll per revolution of the roll. The length of web unwound per revolution of the roll is compared to a first pre-selected length. When the length unwound per revolution of the roll falls below the first pre-selected length, the system determines the length of web unwound from the roll per a pre-selected number of revolutions of the roll. When the length of web unwound per the pre-selected number of revolutions of the roll reaches a second pre-selected length, a warning signal is generated. Thereafter, the measurement of length of web unwound per revolution of the roll is dynamically incremented. When the length of web unwound per the pre-selected number of revolutions of the roll again reaches the second pre-selected length, the splice mechanism is actuated to initiate a splice sequence.

15 Claims, 3 Drawing Figures

AUTOMATIC WEB SPLICE CONTROL SYSTEM

BACKGROUND OF THE INVENTION

The present invention is directed to an automatic web splice control system for a web splicer apparatus. In particular, the invention is directed to a modular digital system wherein web splice control is exercised purely as a function of web roll revolutions and web length unwound from a running web roll. The system eliminates the need for optical sensors and the like which are used in conventional web controls to sense the level of web remaining on a running roll. The system also avoids elaborate computational circuitry which is used in conventional web controls to calculate cross-sectional area of the web roll, web caliper and the like.

Conventional web splice controls are described in U.S. Pat. Nos. 3,990,647; 3,994,449; 3,974,490; 3,953,713 and 3,161,367. A computer operated web splice control is described in IBM General Systems Division Bulletin 5798 NRN, Dec. 13, 1974. The computer system described therein requires a mainframe computer and considerable programming material, all of which are avoided by the present invention.

An advantage of the present invention is that it permits automatic web splice control without optical sensors or the like for detecting the level of remaining web on a roll.

Another advantage of the invention is that it permits automatic web splice control without relatively complex intermediate calculations of web cross-sectional area and caliper.

Another advantage of the invention is that it avoids elaborate computational circuitry, conventionally required to exercise automatic web splice control.

A further advantage of the invention is that it is completely modular and employs readily available digital components which are easily interchanged to facilitate repair.

A still further advantage of the invention is that it provides a warning signal to the operator to allow the operator to prepare for a splice sequence.

Further advantages of the invention appear hereinafter.

SUMMARY OF THE INVENTION

An automatic web splice control system for a web splicer apparatus including at least one running web roll and one ready web roll and a splice mechanism for splicing the expiring end of the running web to the leading end of the ready web. First means measure the length of web unwound from the running web roll per revolution of the roll. Second means determine that the length of web unwound from the running web roll per revolution of the roll is less than a first pre-selected length. Third means determine that the length of web unwound from the running web roll per a pre-selected number of revolutions of the roll reaches a second pre-selected length. Fourth means operatively connected to the first and second means dynamically increment the first means. Fifth means operatively connected to the third and fourth means cause the splice mechanism to initiate a splice sequence.

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
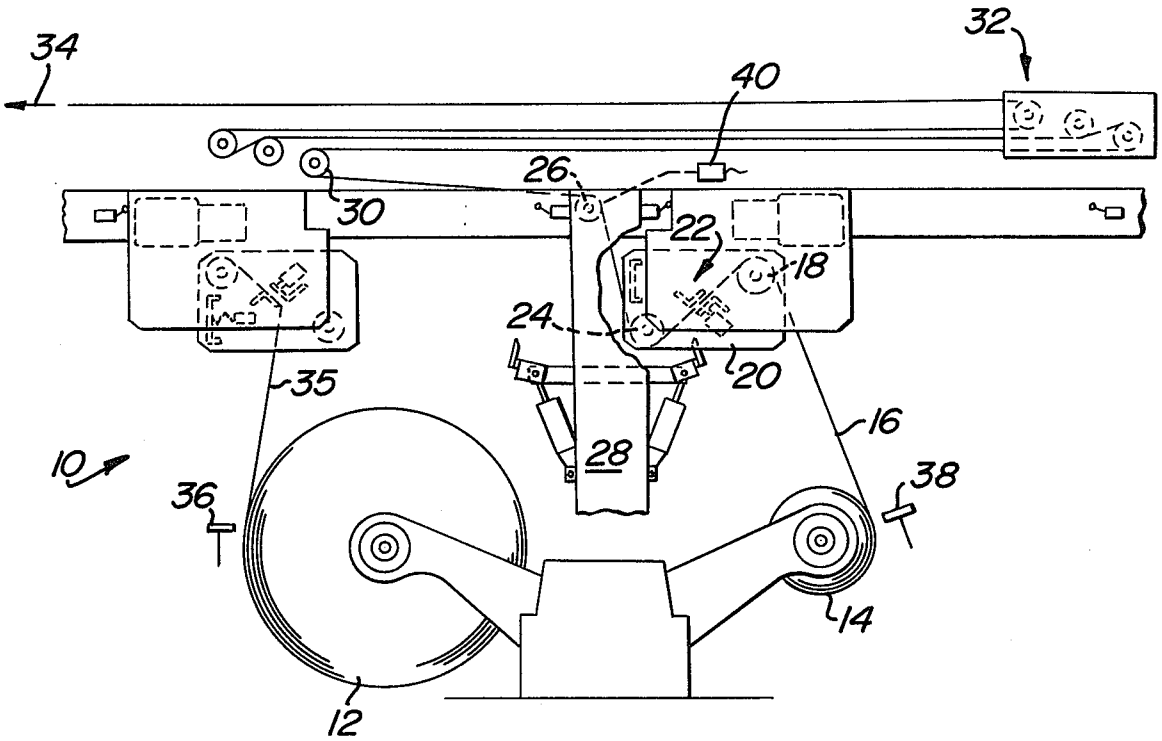
FIG. 1 is an elevation view of a web splicer apparatus for supplying a web from a pair of rolls to a machine which acts on the web.

Referring to the drawing in detail, wherein like numerals indicate like elements, there is shown in FIG. 1 a web splicer apparatus 10 for supplying a web from a pair of web rolls to a machine which acts on the web. One such machine is a paperboard corrugator. The splicer apparatus is adapted to splice the leading edge of the web from the ready roll 12 to the expiring end of a web from the running roll 14 without retarding continuous operation of the machine which acts on the web. The apparatus 10 is described in detail in U.S. Pat. No. 3,841,944 assigned to the assignee herein. The patent is incorporated herein by reference for purposes of description of the background of the present invention. Description of the detailed structure and operation of the web splicer apparatus 10 herein is deemed unnecessary.

As shown in FIG. 1, the running web 16 extends around an idler roller 18 in a splicer head 20. From the idler roller 18, the running web 16 extends through a clamping means 22 and, then, around an idler roller 24.

The web 16 extends from the idler roller 24 upwardly around idler roller 26 on a splicing station 28 and, then, around a dancer roll 30. From the dancer roll 30, the web 16 extends through a festoon 32 or similar accumulation device and, then, in the direction of arrow 34, to a machine such as a corrugator which will act on the web.

Conventionally, when it is ascertained by observation that the running roll 14 is nearly exhausted, the operator depresses a button to activate a motor to initiate a splice sequence wherein the running roll 14 is stopped and the leading edge of the ready web 35 is spliced to the expiring end of the running web 16. The reader is referred to U.S. Pat. No. 3,841,944 for a detailed description of the manner in which the splice is accomplished.

At any convenient time following a splice, a new ready roll will be substituted for the remainder of the running roll 14. The leading end of the new ready web will be threaded through the splicer head 20 at the convenience of the operator.

In the present invention, manual supervision of the splice sequence is eliminated. The splice sequence is initiated without any operator participation. The control is fully automatic, and the control is exercised purely in response to first sensor means 36, second sensor means 38 and third sensor means 40 which are respectively associated with ready roll 12, running roll 14 and idler roller 26.

MEASURING THE LENGTH OF WEB UNWOUND FROM THE RUNNING WEB ROLL PER REVOLUTION OF THE ROLL

First and second sensor means 36 and 38 provide first and second signals respectively per each revolution of the web rolls with which they are associated. As shown in FIG. 1, sensor means 36 is associated with roll 12, and sensor means 38 is associated with roll 14. For purposes of explanation herein, roll 14 is shown as the running roll and roll 12 is shown as the ready roll. After a splice is completed, of course, roll 12 becomes the new running roll and roll 14 is replaced with a fresh ready roll. First and second sensor means 36 and 38 are preferably of the magnetic type, and each sensor means provides a pulse output per each revolution of its associated roll.

Figure 2A:
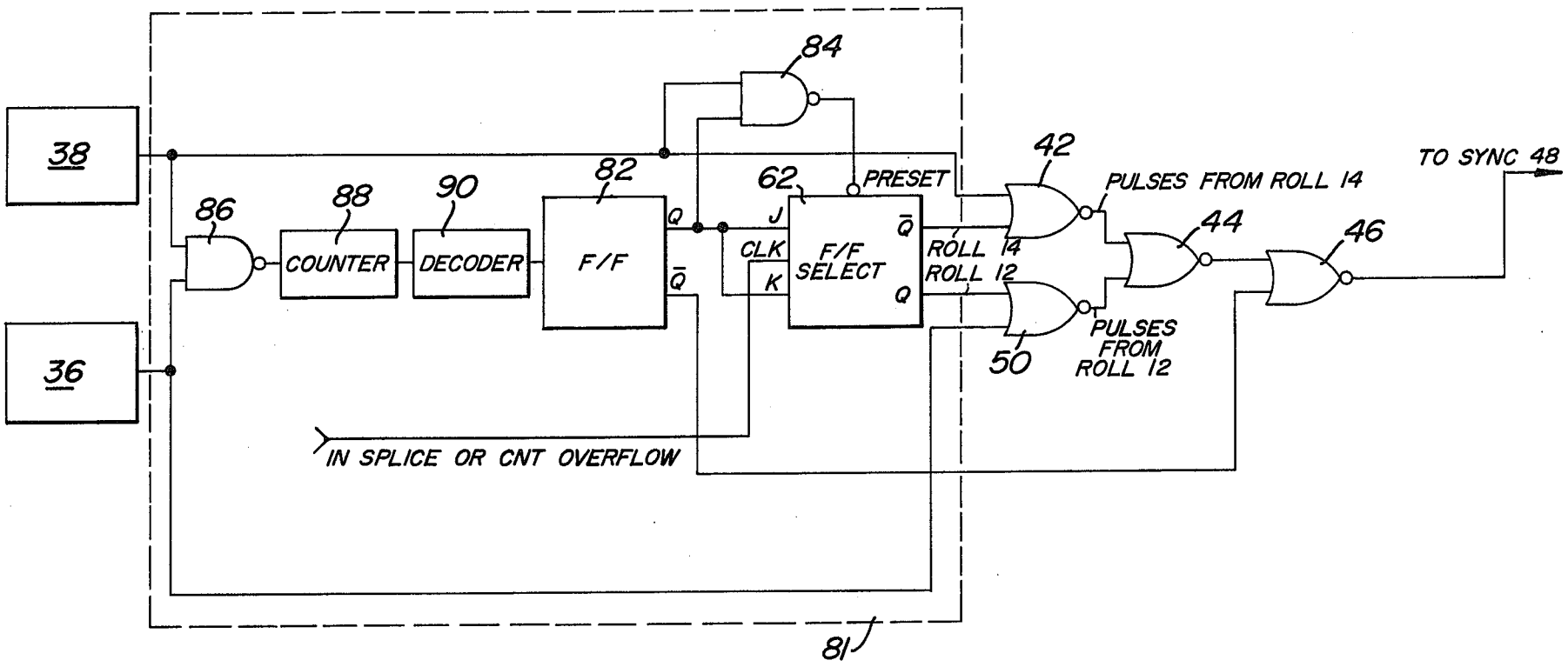
FIGS. 2*a* and 2*b* comprise a block diagram of the automatic web splice control system of the present invention.
Figure 2B:
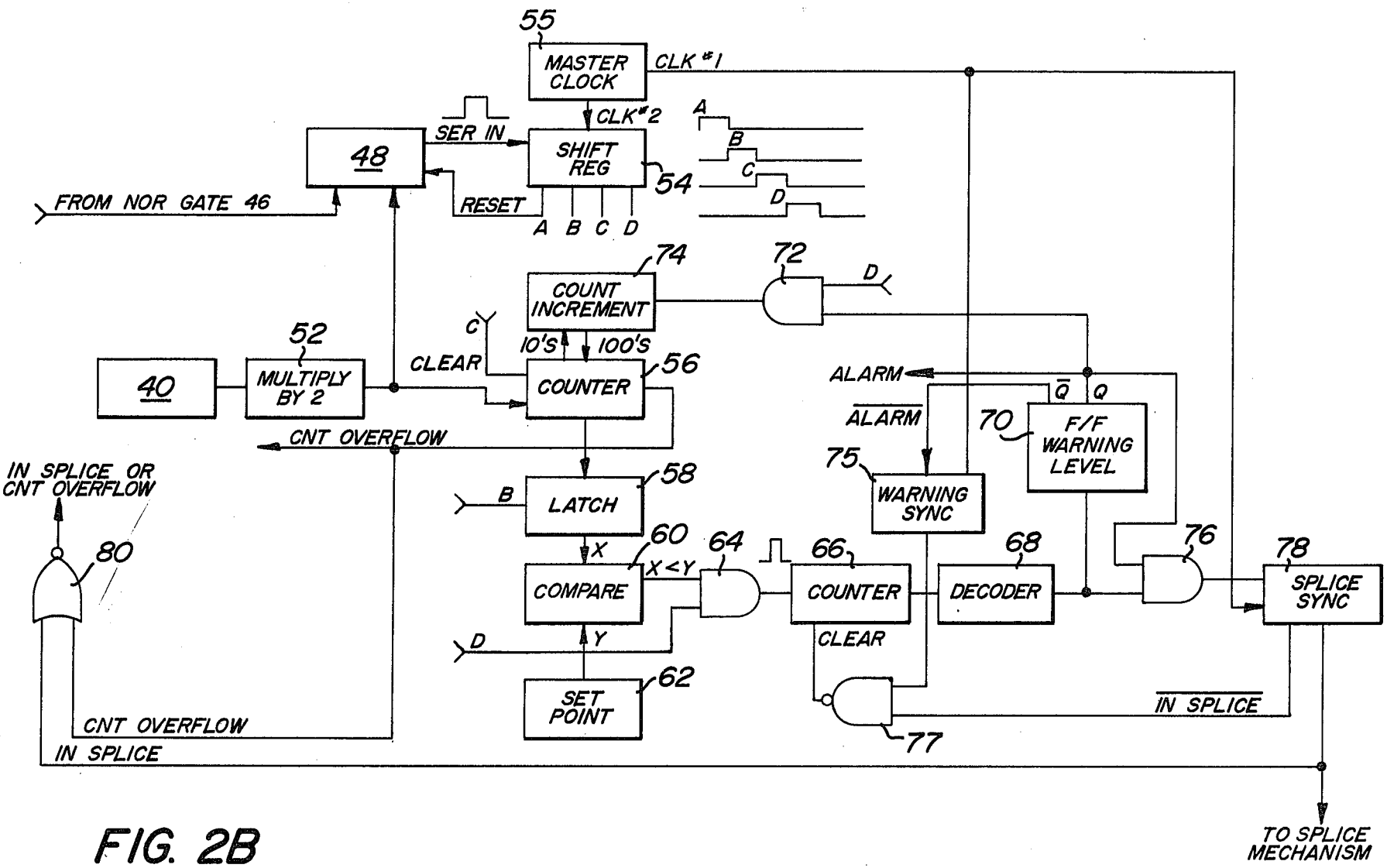

When roll 14 is running, the pulses produced by second sensor means 38 are passed by NOR gate 42, NOR gate 44 and NOR gate 46 to a synchronizer 48. See FIG. 2A. When web roll 12 is the running roll, the pulses produced by first sensor means 36 are passed by NOR gate 50, NOR gate 44 and NOR gate 46 to synchronizer 48. The pulses from NOR gate 46 are synchronized by means of synchronizer 48 to the pulses produced by third sensor means 40. See FIG. 2B. Third sensor means 40 is operatively associated with idler roller 26 in the web splicer apparatus. See FIG. 1. Sensor means 40 is preferably a shaft encoder or the like which generates a pulse output per predetermined increments of travel of the running web 16. The pulse repetition rate of the output of sensor means 40 is increased by a constant factor, preferably two, by multiplier circuit 52. See FIG. 2B. This effectively increases the resolution of the output of the sensor means. The synchronizer 48 provides serial input data to a shift register 54. This data is clocked through the shift register by means of a master clock signal clk #2 which is a digital signal having a frequency of approximately 70 Khz. The clk #2 signal is generated by a master clock 55. The shift register 54 provides a plurality of synchronizing signals A, B, C and D each of which have a duration of approximately 1.4 micro seconds. The synchronizing signals are generated in sequence during each revolution of the running roll. As described in detail hereinafter, the synchronizing signals are used to synchronize the sequence of measurements of length of web unwound from the running web roll.

Synchronizing signal A resets synchronizer 48 to permit the synchronizer to provide serial input data to the shift register for successive revolutions of the running web roll 14. The output of multiplier circuit 52 is counted by a counter 56 between successive synchronizing signals C corresponding to successive revolutions of the running web roll. The contents of counter 56 represent the length of running web 16 unwound from the running web roll per revolution of the roll. The synchronizing signal B actuates a latch circuit 58 which temporarily stores the contents of counter 56 just before the counter is cleared by the synchronizing signal C. A comparator 60 continuously compares the contents of the latch 58, denoted "X", with the output of a set point circuit 62 denoted "Y". The Y output of the set point circuit 62 represents a first preselected length of web unwound from the running web roll. The set point circuit 62 is preferably a set of internal thumb wheel switches or the like which are pre-adjusted for the desired application. The switches are not adjusted thereafter by the operator.

The comparison of the X and Y signals is repeated for successive revolutions of the running roll. If the length of web unwound from the running roll per revolution of the roll is greater than the first pre-selected web length, signal X will be greater than signal Y and comparator 60 will disable AND gate 64. The running roll continues to unwind, and when the length of web unwound from the running roll per revolution of the roll is less than the first pre-selected web length, signal X will be less than signal Y and the comparator 60 will enable AND gate 64. When enabled, AND gate 64 passes the synchronizing signal D to a counter 66. The counter 66 counts the synchronizing signal D for successive revolutions of the running roll for which signal X is less than signal Y. In other words, counter 66 counts the number of revolutions of the running roll for which the length of web unwound from the roll is less than the first pre-selected length. The contents of counter 66, then, represent the length of web unwound from the running roll after the level of the web on the running roll has reached a first pre-selected radius corresponding to the first pre-selected web length.

Counter 66 continues to count the synchronizing signal D until a fixed count NO is reached. The fixed count NO represents a second pre-selected length of web unwound from the running roll. In particular, it indicates that the level of the web on the running roll has reached a second pre-selected radius in advance of the level at which a splice is to be initiated. When the counter 66 reaches the fixed count NO, decoder 68 sets a warning level flip-flop 70. The warning level flip-flop 70 generates an alarm signal at its Q output. The alarm signal is used to drive an alarm device, such as a light or horn, to indicate to the operator that a splice will soon take place.

When set, the warning flip-flop 70 also enables a AND gate 72 which passes the synchronizing signal D to a count increment circuit 74. The count increment circuit 74 dynamically increments the count in counter 56 to effectuate measurement of the length of web unwound from the running roll after the warning level flip-flop has been set.

When the warning level flip-flop is set, the $\overline{Q}$ output of the flip-flop enables a warning synchronizer 75 to pass a master clock signal clk #1 via NAND gate 77 to clear counter 66. Clock signal clk #1 has a pulse repetition frequency approximately eight times faster than the clk #2 signal.

DYNAMICALLY INCREMENTING THE MEASUREMENT OF WEB LENGTH

The count increment circuit 74 is preferably a two-input OR gate. One input of the count increment circuit is the output of AND gate 72. The other input of the circuit is taken from one of the stages of counter 56, preferably the tens stage. The output of the count increment circuit is connected to another stage of counter 66, preferably the hundred's stage of counter 56 during each measurement of web length unwound per revolution of the running roll after the warning or alarm signal has been generated. By "dynamically" is meant that the count in counter 56 is incremented by the same amount during successive revolutions of the running roll. By dynamically incrementing the count in counter 56 after the warning signal has been generated, the same digital circuitry that determines the moment that the warning signal is generated can be used to determine the moment that a splice is to occur.

The counter 56 continues to count the output of multiplier circuit 52, as incremented by the count increment circuit 74, and the comparator 60 repeats the comparison of signal X to signal Y as previously described. When the incremented count in counter 56, represented by signal X, falls below the first pre-selected web length, indicated by signal Y, counter 66 and decoder 68 repeat the count of total web length unwound from the running roll for NO revolutions of the roll. When the fixed count NO is again reached, decoder 68 enables AND gate 76. The AND gate 76 passes the alarm signal at the Q output of flip-flop 70 to enable a splice synchronizer 78. The splice synchronizer generates an "in splice" signal in response to the "clk #1" output of the master clock 55.

The "in splice" signal is fed to the splice mechanism in the web splicer apparatus 10 to cause the mechanism to initiate a splice sequence. The "in splice" signal is also passed via NOR gate 80 to toggle flip-flop 62 thereby enabling the system to repeat all of the foregoing operations after the splice has been completed. See FIGS. 2A and 2B. Following the splice, roll 12 will become the running roll and roll 14 will be replaced by a fresh ready roll. Flip-flop 62 automatically selects the sensor means 36 or 38 which is associated with the new running roll, and the system repeats each of the measurements previously described for the new running roll. See FIG. 2A. The operation of flip-flop 62 in selecting pulses from sensor means 36 or 38 for control of the web splicer apparatus is described in detail hereinafter.

SELECTION OF SENSOR MEANS PULSES

Selection circuit 81 determines whether control of the web splicer apparatus will be exercised in response to the output of sensor means 36, via NOR gates 50, 44 and 46, or in response to the output of sensor means 38 via NOR gates 42, 44 and 46. See FIG. 2A. When flip-flop 82 is set, the Q output of the flip-flop enables a NAND gate 84. Initially, web roll 14 is the running roll and the pulses produced by second sensor means 38 are passed via NAND gate 84 to pre-set flip-flop 62. Accordingly, the Q output of flip-flop 62 enables NOR gate 42 to pass the pulses produced by sensor means 38 to NOR gate 44. NOR gate 44 will be enabled by the output of NOR gate 50 since the $\overline{Q}$ output of flip-flop 62 will keep NOR gate 50 disabled NOR gate 46 will be enabled to pass the output of NOR gate 44 to synchronizer 48 since the $\overline{Q}$ output of flip-flop 82 is low when the flip-flop is set. Accordingly, synchronizer 48 will control shift register 54 in response to the pulses from sensor means 38, that is, in response to revolutions of the running roll 14.

When flip-flop 82 is set, the Q output of the flip-flop maintains flip-flop 62 in a toggle condition. After a splice sequence has been initiated, the "in splice" signal is passed by NOR gate 80 to toggle flip-flop 62 as previously explained. As a result, the Q and $\overline{Q}$ outputs of flip-flop 62 change state to disable NOR gate 42 and enable NOR gate 50. NOR gate 50 will thereafter pass the pulses produced by first sensor means 36. Since web roll 12 will now become the new running roll, sensor means 36 will indicate the revolutions of the running roll. The pulses produced by sensor means 36 will be passed via NOR gates 50, 44 and 46 to synchronizer 48. Control of the web splicer apparatus will thereafter be exercised in response to the pulses from sensor means 36, that is, in response to rotation of the new running roll 12. When roll 12 is exhausted, roll 14 will become the new running roll, flip-flop 62 will again be toggled, and control of the web splicer apparatus will be exercised in response to rotation of roll 14. Regardless of which of rolls 12 and 14 is the running roll, then, control of the web splicer apparatus remains the same.

DISCRIMINATION AGAINST NOISE

When power is initially applied to the system at start-up, both rolls 12 and 14 will be stationary. Due to unwanted vibrations of the rolls, however, sensor means 36 and/or 38 may emit one or more noise-like pulses. The system automatically discriminates against such noise-like pulses by means of NAND gate 86, counter 88 and decoder 90. See FIG. 2A.

Noise-like pulses generated by sensor means 36 or 38 are passed by NAND gate 86 and counted by counter 88. If the counter counts up to a fixed number E0, decoder 90 sets flip-flop 82. The fixed number E0 is empirically determined to exceed the maximum number of noise-like pulses likely to be generated by sensor means 36 or 38 due to unwanted vibrations of the web rolls. Accordingly, if only noise-like pulses are encountered, counter 88 will not reach the fixed number E0 and flip-flop 82 will remain reset. The $\overline{Q}$ output of flip-flop 82 will therefore disable NOR gate 46 from transmitting any pulses to synchronizer 48, and the system will be inhibited from initiating operation.

When running roll 14 begins to rotate, sensor means 38 will generate a series of pulses at its output. The pulses will be transmitted by NAND gate 86 to counter 88. Counter 88 will count the pulses, and when the count reaches the fixed count E0, the decoder 90 will set flip-flop 82. Thereafter, control of the web splicer apparatus is exercised as previously explained.

In operation, the system measures the length of running web unwound per revolution of the running roll. When the length of web unwound per revolution of the running roll falls below a first pre-selected length, the system measures the length of web unwound from the roll for a fixed number of revolutions N0 of the roll. After N0 revolutions of the roll, the length of web unwound from the roll reaches a second pre-selected web length. At this time, a warning signal is generated to indicate to the operator that a splicing sequence will soon commence. Thereafter, the measurement of web length unwound per revolution of the running roll is dynamically incremented, and the foregoing measurements are repeated by the same digital circuitry. After the second pre-selected web length is again reached, a splicing operation is initiated.

The foregoing measurements are simple and straightforward. No complex computations of web roll cross-section area, web caliper or the like are required. Complex computational circuitry is entirely avoided. The system comprises modular digital components which are readily available. Repair of the system may be rapidly and efficiently effected since the modular components are interchangeable.

The system requires no programming software, and it is designed to operate as a stand-alone unit without connection to a mainframe computer or other costly equipment.

The invention has been described in terms of certain digital logic components such as counters, decoders, flip-flops, synchronizers and logic gates. It would be obvious to a person of ordinary skill in the art to replace certain of the components with other components which perform as the full functional equivalent of those described herein without exceeding the spirit or scope of the invention. In addition, it should be obvious that certain conventional components can be added to the invention without affecting the scope thereof. For example, a conventional power on reset circuit can be employed to reset each of the digital components described herein when power is first applied to the system.

The present invention may be embodied in other specific forms without departing from the spirit or essential attributes thereof and, accordingly, reference should be made to the appended claims, rather than to the foregoing specification as indicating the scope of the invention.

We claim:

1. An automatic splice control system for a web splicer apparatus which includes at least one running web roll and one ready web roll and a splice mechanism for splicing the expiring end of the running web to the leading end of the ready web, comprising:

first means for measuring the length of web unwound from a running web roll per revolution of the roll;

second means for determining that the length of web unwound from the running web roll per revolution of the roll is less than a first pre-selected length;

third means for determining that the length of web unwound from the running web roll per a pre-selected number of revolutions of the roll reaches a second pre-selected length;

fourth means operatively connected to said first and third means for dynamically incrementing said first means; and, fifth means connected to said third and fourth means for causing a splice mechanism to initiate a splice sequence wherein the expiring end of the web on the running web roll is spliced to the leading end of the web on the ready web roll.

2. The automatic web splice control system according to claim 1 wherein said third means includes means for generating a warning signal when said length of web unwound from said running web roll per a pre-selected number of revolutions of the roll reaches said second pre-selected length.

3. The automatic web splice control system according to claim 1 including means for synchronizing the operation of said first, second, third, fourth and fifth means.

4. The automatic web splice control system according to claim 1 wherein said third means includes a counter and a decoder operatively connected thereto.

5. The automatic web splice system according to claim 1 wherein said first means includes a first sensor means operatively associated with the running web roll for providing a first signal per each revolution of the running roll, a second sensor means operatively associated with the ready web roll for providing a second signal per each revolution of the ready roll and means for automatically selecting said first signal to measure the length of web unwound from the running web roll.

6. The automatic web splice control system according to claim 5 including means for discriminating between said first signal and noise due to unwanted movement of said running and ready web rolls.

7. The automatic web splice control system according to claim 5 wherein said first means includes a third sensor means for providing a third signal per preselected increments of travel of the web unwound from the running roll, and a counter operatively connected thereto for counting said third signal.

8. An automatic web splice control system for a web splicing apparatus which includes at least one running web roll and one ready web roll and a splice mechanism for splicing the expiring end of the running web to the leading end of the ready web, comprising:

first means for determining that the length of web unwound from a running web roll per revolution of the roll is less than a first pre-selected length;

second means for determining that the length of web unwound from the running web roll per a preselected number of revolutions of the roll reaches a second pre-selected length;

third means operatively connected to said first and second means for dynamically incrementing said first means; and, fourth means operatively connected to said second and third means for causing a splice mechanism to initiate a splice sequence wherein the expiring end of the web on the running web roll is spliced to the leading end of the web on the ready web roll;

9. The automatic web splice control system according to claim 8 wherein said first means includes a first sensor means operatively associated with the running web roll for providing a first signal per each revolution of the running web roll, a second sensor means operatively associated with the ready web roll for providing a second signal per each revolution of the ready web roll, and means for automatically selecting said first signal to measure the length of web unwound from the running web roll.

10. A method of automatically controlling a web splicer apparatus which includes at least one running web roll and one ready roll and a splice mechanism for splicing the expiring end of the running web to the leading end of the ready web, comprising:

(a) measuring the length of web unwound from a running web roll per revolution of the roll;

(b) determining that the length of web unwound from the running web roll per revolution of the roll is less than a first pre-selected length;

(c) determining that the length of web unwound from the running web roll per a pre-selected number of revolutions of the roll reaches a second preselected length;

(d) dynamically incrementing the measurement of web length obtained in step (a); and (e) generating a splice signal to indicate that a splice mechanism should initiate a splice sequence wherein the expiring end of the web on the running web roll is spliced to the leading end of the web on the ready web roll, as a function of steps (a) – (d).

11. An automatic control system for a web material consuming apparatus which includes at least one running roll of web material and a mechanism for operating on the web material after a preselected length of the material has been unwound from the running roll, comprising:

first means for measuring the length of web unwound from the running roll per revolution of the roll, second means for determining that the length of web unwound from the running web per revolution of the roll is less than a first preselected length;

third means for determining that the length of web unwound from the running web roll per a preselected number of revolutions of the roll reaches a second preselected length;

fourth means operatively connected to said first and third means for dynamically incrementing said first means; and fifth means connected to said third and fourth means for causing the operating mechanism to initiate an operation.

12. The automatic control system according to claim 11 wherein said third means includes means for generating a warning signal when said length of web material unwound from said running web roll per a preselected number of revolutions of the roll reaches said second preselected length.

13. The automatic control system according to claim 11 wherein said first means includes a first sensor means operatively associated with the running web roll for providing a first signal per each revolution of the running roll, a second sensor means operatively associated with the ready web roll for providing a second signal per each revolution of the ready roll and means for automatically selecting said first signal to measure the length of web material unwound from the running web roll.

14. The automatic control according to claim 13 including means for discriminating between said first signal and noise due to unwanted vibrations of said running and ready web rolls.

15. A method of automatically controlling a web material consuming apparatus which includes at least one running roll of web material and a mechanism for operating on the web material, comprising:

(a) measuring the length of web material unwound from the running roll per revolution of the roll;
(b) determining that the length of web material unwound from the running web roll per revolution of the roll is less than a first preselected length;
(c) determining that the length of web material unwound from the running roll per a preselected number of revolutions of the roll reaches a second preselected length;
(d) dynamically incrementing the measurement of web length obtained in step (a); and
(e) generating a signal to indicate that the operating mechanism should initiate an operation.

* * * * *